US008257900B2

(12) United States Patent
Noge

(10) Patent No.: US 8,257,900 B2
(45) Date of Patent: Sep. 4, 2012

(54) METHOD FOR PREPARING TONER, TONER PREPARED BY THE METHOD, AND IMAGE FORMING APPARATUS USING THE TONER

(75) Inventor: Kouji Noge, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 655 days.

(21) Appl. No.: 12/390,750

(22) Filed: Feb. 23, 2009

(65) Prior Publication Data

US 2009/0233213 A1 Sep. 17, 2009

(30) Foreign Application Priority Data

Mar. 17, 2008 (JP) ..... 2008-068574

(51) Int. Cl.
*G03G 9/08* (2006.01)

(52) U.S. Cl. ..... 430/137.2; 430/137.18

(58) Field of Classification Search ..... 430/137.2, 430/137.18

See application file for complete search history.

(56) References Cited

U.S. PATENT DOCUMENTS

| | | | | |
|---|---|---|---|---|
| 4,562,972 | A | 1/1986 | Hagiwara et al. | |
| 6,368,765 | B2 | 4/2002 | Izu et al. | |
| 6,395,332 | B1 * | 5/2002 | Hanawa et al. | 427/216 |
| 6,475,690 | B2 * | 11/2002 | Anno et al. | 430/108.8 |
| 6,562,538 | B2 * | 5/2003 | Miyamoto | 430/108.6 |
| 6,656,655 | B2 * | 12/2003 | Anno et al. | 430/108.8 |
| 2005/0158648 | A1 * | 7/2005 | Makino et al. | 430/110.4 |
| 2008/0227022 | A1 | 9/2008 | Noge et al. | |

FOREIGN PATENT DOCUMENTS

| | | | |
|---|---|---|---|
| EP | 0 265 910 | A2 | 5/1988 |
| EP | 0 265 910 | A3 | 5/1988 |
| EP | 1 455 237 | A3 | 9/2004 |
| JP | 59-196754 | | 11/1984 |
| JP | 60-173552 | | 9/1985 |
| JP | 5-313414 | | 11/1993 |
| JP | 6-308767 | | 11/1994 |
| JP | 7-92728 | | 4/1995 |
| JP | 9-179411 | | 7/1997 |
| JP | 10-211438 | | 8/1998 |
| JP | 11-276916 | | 10/1999 |
| JP | 2001-201892 | | 7/2001 |
| JP | 2003-117426 | | 4/2003 |
| JP | 2004-113839 | | 4/2004 |
| JP | 2004-330062 | | 11/2004 |
| JP | 2005-21768 | | 1/2005 |
| JP | 2005-99690 | | 4/2005 |
| JP | 2005-195762 | | 7/2005 |
| JP | 2006-235202 | | 9/2006 |

OTHER PUBLICATIONS

Japanese Office Action mailed May 10, 2012, in Japanese Patent Application No. 2008-068574.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A method for preparing a toner including primarily pulverizing a toner composition powder including at least a binder resin and a colorant using a mechanical pulverizer to prepare a first particulate material with a weight average particle diameter of 7 to 30 μm; secondarily pulverizing the first particulate material using a jet air pulverizer having a pulverization plate to prepare a second particulate material; and classifying the second particulate material in two steps to prepare particles of the toner with a weight average particle diameter of 2 to 6 μm and an average circularity of 0.93 to 0.96. A toner including toner particles including at least a binder resin and a colorant and prepared by the method. An image forming apparatus including an image bearing member configured to bear an electrostatic image thereon; and a developing device configured to develop the electrostatic image with a developer including the toner.

3 Claims, 2 Drawing Sheets

METHOD FOR PREPARING TONER, TONER PREPARED BY THE METHOD, AND IMAGE FORMING APPARATUS USING THE TONER

BACKGROUND OF THE INVENTION

1. Field of the Invention

The present invention relates to a method for preparing a toner. In addition, the present invention also relates to a toner prepared by the method, and to an image forming apparatus using the toner.

2. Discussion of the Background

Jet air pulverizers pulverize a material by flowing the material at a speed of about 850 m/s using a jet air to collide the material with a collision plate thereof. One example of such jet air pulverizers is an I-type jet mill from Nippon Pneumatic Mfg. Co., Ltd., which is disclosed in a published examined Japanese patent application No. (herein after referred to as JP-B) 05-027851. By using such a jet air pulverizer for preparing toner, toner particles having a relatively small weight average particle diameter of from 2 to 6 can be prepared. However, jet air pulverizers have the following drawbacks:

(1) The resultant toner particles have an average circularity of from 0.92 to 0.94 (i.e., spherical toner particles cannot be prepared), and therefore the image qualities of images produced by the toner are not so good; and (2) The specific energy consumption in the toner preparation process (i.e., energy needed for producing a toner with a unit weight) is very bad.

In contrast, mechanical pulverizers pulverize a material by feeding the material into a gap formed between a concavo-convex rotor rotated at a revolution of about 140 m/s and a concavo-convex stator to collide the material with the projected portions and recessed portions of the rotor and stator and to collide particles of the material with each other. Specific examples of the mechanical pulverizers include:

(1) Turbomills (from Turbo Kogyo Co., Ltd.) disclosed in published unexamined Japanese patent applications Nos. (herein after referred to as JP-As) 2005-021768 and 11-276916;

(2) Fine mills (from Nippon Pneumatic Mfg. Co., Ltd.) disclosed in JP-A 2003-117426; and (3) CRYPTRON (from Kawasaki Heavy Industries, Ltd.) disclosed in JP-A 2004-330062.

When a toner is prepared using such mechanical pulverizers, the inner temperature of the pulverizers increases in the process of pulverizing a toner constituent mixture including a binder resin. Therefore, in order to prevent the toner constituent mixture and resultant toner particle from melting and adhering to the inner surface of the pulverizers, the following methods are typically used:

(1) Cold water is flown in a jacket provided outside the pulverizers to cool the pulverizers (disclosed in, for example, JP-B 63-66584); and (2) Cold air is fed together with the toner constituent mixture to be pulverized.

Recently, a strong need exists for a pulverizer or a pulverizing method, which can stably produce toner having a relatively small average particle diameter of about few micrometers even when used for a long period of time. However, since the above-mentioned mechanical pulverizers have the below-mentioned drawbacks, such a small toner cannot be stably produced.

(1) The toner constituent mixture to be pulverized and the resultant toner particles are melted in the pulverizer and are fixedly adhered to the inner surface of the pulverizer due to energies caused by friction and collision of the toner constituent mixture with the inner surface of the pulverizer, resulting in deterioration of productivity (pulverizing ability) of the pulverizer;

(2) Low molecular weight components and/or waxes included in the toner constituent mixture (and the resultant toner particles) exude from therefrom due to increase of the inner temperature of the pulverizer caused by frictional heat (which is caused by deterioration of the pulverizing ability of the pulverizer) resulting in deterioration of the properties of the toner;

(3) The toner constituent mixture to be pulverized and the resultant toner particles are fixedly adhered to the inner surface of the pulverizer due to changes of environmental conditions (such as humidity), resulting in deterioration of the pulverizing ability of the pulverizer; and (4) The qualities of toner images formed by the toner prepared in paragraphs (1)-(3) above deteriorate (for example, formation of images with background development, poor fixing properties, white spots and/or low image density).

Thus, mechanical pulverizers cannot stably produce toner having a relatively small average particle diameter of about few micrometers, and in addition the qualities of the resultant toner are not good. In addition, mechanical pulverizers can stably produce toner particles, which have a sharp particle diameter distribution including a little amount of super fine particles and whose surface is modified so as to have an average circularity of from 0.94 to 0.96, at a high yield. Further, mechanical pulverizers have good specific energy consumption and the resultant toner particles have good cleanability. However, the lower limit of the average particle diameter of the resultant toner particles is about 7 μm, and toner particles having a smaller average particle diameter (of not greater than 6 μm) cannot be produced.

In addition, there are counter air flow pulverizers in which particles of a material to be pulverized are collided with each other at a speed of 850 m/s using opposed airflows, resulting pulverization of the material. Specific examples of the counter airflow pulverizers include 400AFG from Hosokawa Micron Corp., which is disclosed in a Japanese patent No. 3957066 (i.e., JP-A 2004-113839). The toner particles produced by using such counter airflow pulverizers have a sharp particle diameter distribution including a little amount of super fine particles and the surface thereof is modified so that the toner particles have an average circularity of from 0.92 to 0.94 (i.e., the particles are not spherical). Although counter airflow pulverizers can stably produce small toner particles with a weight average diameter of from 2 to 6 μm, the specific energy consumption of the pulverizers is not good.

In this regard, toner particles having too high an average circularity can produce clear images, but such toner particles have poor cleanability. In contrast, toner particles having a low circularity cannot produce clear images.

A pulverizer having a low specific energy consumption can produce a toner with a reduced energy. Specific energy consumption is defined as the amount of $CO_2$ (in units of kg or t) produced when a toner with a unit weight (1 kg or 1 t) is produced. In this regard, the amount of $CO_2$ is calculated by the following equation:

$$\text{Amount of } CO_2\ (t) = 0.378 \times EP,$$

wherein EP represents the electric power needed for producing the toner in units of MWh.

For example, assuming that 500 t of a toner is produced in a month using a pulverizing system, whose electric power consumption is 2000 MWh per month. In this case, the specific energy consumption of the pulverizing system is obtained as follows:

$$2000\ (\text{MWh/month}) \times 0.378\ (\text{t/MWh})/500\ (\text{t/month}) = 1.512\ \text{t/t}.$$

Thus, the specific energy consumption of the pulverizing system is 1.512 t/t. The lower specific energy consumption a pulverizer has, the better productivity the pulverizer has, i.e., the better carbon dioxide reducing effect the pulverizer has. Therefore, the pulverizer is useful for preventing the earth from warming.

There are no conventional pulverizing methods or pulverizers, which can stably produce toner particles having a high circularity and a sharp particle diameter distribution including a little amount of super fine particles at a low energy consumption and a high yield.

In addition, there are no conventional pulverizing methods or pulverizers, which can produce a long life toner having a good combination of developing property, transferring property, cleaning property and charge stability.

Japanese patent No. 3916826 (i.e., JP-A 2001-201892, corresponding to U.S. Pat. No. 6,368,765) discloses a method for preparing a toner for use in developing an electrostatic image, which includes providing a preliminarily pulverized toner constituent mixture including at least a binder resin and a colorant; and then finely pulverizing preliminarily pulverized toner constituent mixture using a jet pulverizer to prepare toner particles. In this regard, the preliminarily pulverized toner constituent mixture satisfies the following relationship (1)

$$Dv \geqq D_{10} \quad (1),$$

wherein Dv represents the weight average particle diameter of the preliminarily pulverized toner constituent mixture, and $D_{10}$ represents the 10% cumulative particle diameter of the preliminarily pulverized toner constituent mixture (i.e., particles having the particle diameter $D_{10}$ or smaller particle diameters are included in the preliminarily toner constituent mixture in an amount of 10%).

In addition, in this method, the pulverization energy of the fine pulverizer is from 0.3 to 1.1 kw·h/kg·h, the content of fine toner particles having diameters of not greater than 5 μm in the resultant toner particles is not greater than 50%, and the following relationship (2) is satisfied:

$$D'_{50} < 3D'_{10} \quad (2),$$

wherein $D'_{50}$ represents the 50% cumulative particle diameter of the toner particles, and $D'_{10}$ represents the 10% cumulative particle diameter of the toner particles.

In the present application, this technique is further improved and developed.

SUMMARY OF THE INVENTION

As an aspect of the present invention, a method for preparing a toner is provided, which includes:

primarily pulverizing a toner composition powder (i.e., a crushed toner constituent mixture) including at least a binder resin and a colorant using a mechanical pulverizer to prepare a first particulate material with a weight average particle diameter of from 7 to 30 μm;

secondarily pulverizing the first particulate material using a jet air pulverizer having a pulverization plate to prepare a second particulate material; and classifying the second particulate material in two steps to prepare particles of the toner with a weight average particle diameter of from 2 to 6 μm and an average circularity of from 0.93 to 0.96.

As another aspect of the present invention, a toner for developing an electrostatic image is provided, which includes toner particles prepared by the method mentioned above.

As yet another aspect of the present invention, a container containing the toner mentioned above or a two-component developer including the toner and a carrier is provided.

As a further aspect of the present invention, an image forming apparatus is provided, which includes:

an image bearing member configured to bear an electrostatic image thereon; and a developing device configured to develop the electrostatic image with a developer including the toner mentioned above to form a toner image on the image bearing member, wherein the developing device includes a developer containing portion containing the developer therein.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

As mentioned above, the toner preparation method of the present invention includes the following steps:

primarily pulverizing a toner composition powder (i.e., a crushed toner constituent mixture) including at least a binder resin and a colorant using a mechanical pulverizer to prepare a first particulate material with a weight average particle diameter of from 7 to 30 μm;

secondarily pulverizing the first particulate material using a jet air pulverizer having a pulverization plate to prepare a second particulate material; and classifying the second particulate material in two steps to prepare particles of the toner with a weight average particle diameter of from 2 to 6 μm and an average circularity of from 0.93 to 0.96.

It is preferable for the toner preparation method that the mechanical pulverizer has a rotor rotated at a peripheral speed of not lower than 120 m/s and perform surface pulverization to produce rounded particles having an average circularity of from 0.94 to 0.96 and a weight average particle diameter of from 7 to 20 μm; and the weight average particle diameter of the particles of the resultant toner is from 2 to 5 μm.

In addition, it is also preferable for the toner preparation method that the two-step classification treatment is performed using two classifiers, each of which has a cyclone. In the first classifier, the second particulate material is classified and then collided with the inner surface of the first cyclone to be rounded. In the second classifier, the thus rounded first particulate material is further classified and then collided with the inner surface of the second cyclone to be rounded, resulting in formation of the particles of the toner. In this case, the average circularity and the weight average particle diameter of the particles of the toner are from 0.94 to 0.96 and from 2 to 6 μm, respectively.

The present application also provides a toner, which is prepared by the method mentioned above, and a container containing the toner or a two-component developer containing the toner and a carrier.

Further, the present application provides an image forming apparatus including an image bearing member configured to bear an electrostatic image thereon; and a developing device configured to develop the electrostatic image with a developer including the toner mentioned above to form a toner image on the image bearing member, wherein the developing device includes a developer containing portion containing the developer therein.

The toner preparation method of the present invention will be explained by reference to drawings, which are provided herein for the purpose of illustration only and are not intended to be limiting.

Figure 1:
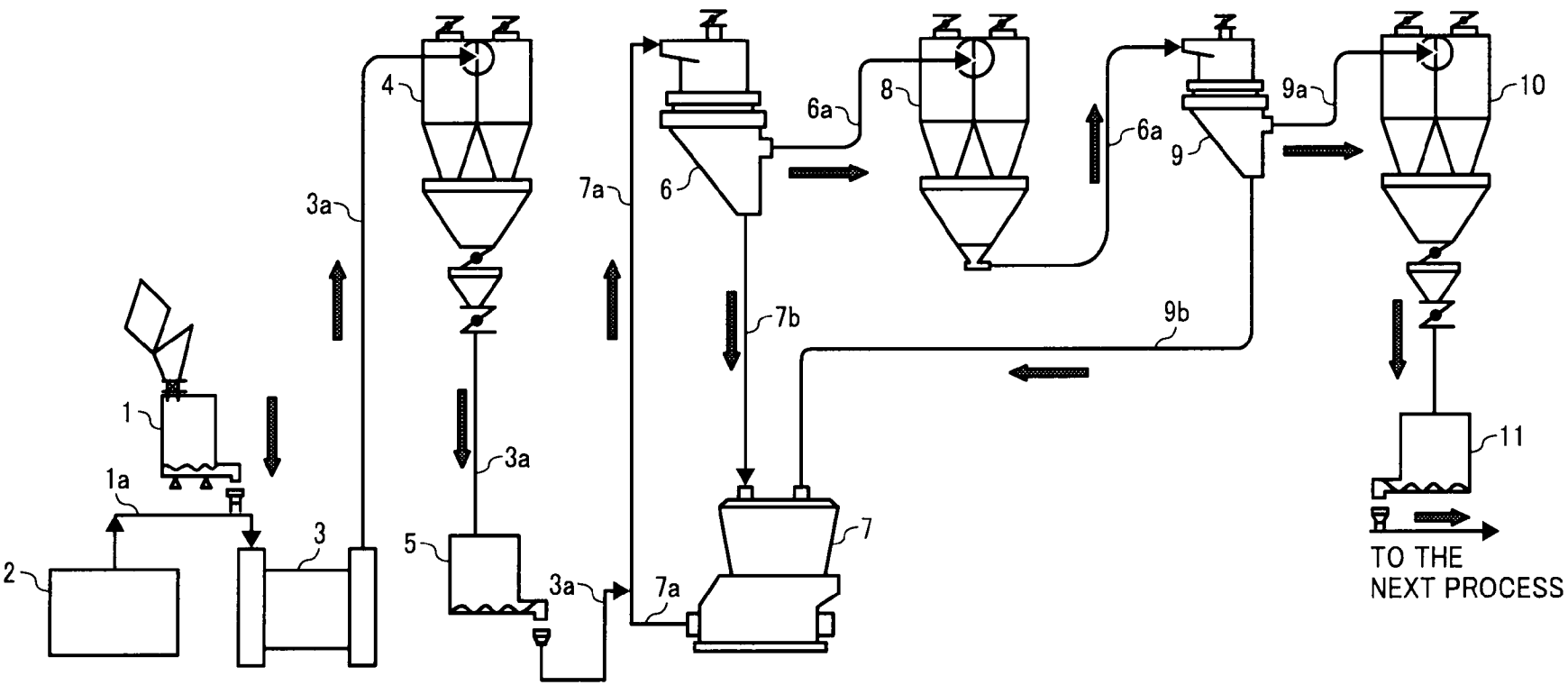
FIG. 1 is a schematic view illustrating a toner preparation system for use in the toner preparation method of the present invention.

FIG. 1 illustrates a toner preparation system for use in the toner preparation method of the present invention.

The system includes a mechanical pulverizer 3, a jet air pulverizer 7, and first and second classifiers 6 and 9. The first particulate material discharged from the mechanical pulverizer 3 is fed to the jet air pulverizer 7 through passages 3*a*, 7*a* and 7*b*, and the first classifier 6. The second particulate material discharged from the jet air pulverizer 7 is fed to the first and second classifiers 6 and 9 through the passage 7*a* and a passage 6*a*, respectively. In this regard, part of or all the particles having particle diameters out of (greater than) the particle diameter range are returned to the jet air pulverizer 7 to be pulverized.

The system will be explained in detail by reference to FIG. 1.

A toner composition powder, which is prepared by crushing a toner constituent mixture including at least a binder resin and a colorant mixed with the binder resin, is fed from an exit of a feeder 1 to the mechanical pulverizer 3 through a passage 1*a* by cooled air supplied by a cool air generating device 2. The toner composition powder thus fed to the mechanical pulverizer 3 is subjected to a primary pulverization treatment therein to prepare a first particulate material having a weight average particle diameter of from 7 to 30 μm. In this regard, the mechanical pulverizer 3 mainly performs surface pulverization, resulting in formation of rounded particles. After the primary pulverization treatment, the first particulate material is fed to a first cyclone 4 provided in a middle point of the passage 3*a* to remove excessively-pulverized particles (i.e., particles having smaller than the lower limit (2 μm) of the predetermined particle diameter range) therefrom and to round the first particulate material. The thus classified and rounded first particulate material is fed to the jet air pulverizer 7 through the passage 3*a* and the passage 7*a*, which is communicated with the passage 3*a* at a point thereof.

After passing through the first cyclone 4, the first particulate material is fed to the passage 7*a* by a feeder 5 provided at an end portion of the passage 3*a*, and then fed to the jet air pulverizer 7 through the passages 7*a* and 7*b* and the first classifier 6. The jet air pulverizer 7 mainly performs volume pulverization and thereby the resultant particles tend to have sharp edges. The first classifier 6 is provided in a middle point of the passage 7*a*. The first classifier 6 feeds relatively fine particles (having particle diameters in the preferable particle diameter range) to the second classifier 9 through the passage 6*a* and a second cyclone 8 configured to round the particles (second particulate material) and to remove particles having too small particle diameters, and feeds relatively large particles, which have not been sufficiently pulverized and have particle diameters greater than the predetermined particle diameter range, to the jet air pulverizer 7 through the passage 7*b* so that the large particles are re-pulverized. Thus, the passage 7*b* serves as a return passage in a circulating system including the first classifier 6, and the jet air pulverizer 7.

Similarly to the first classification treatment, a second classification treatment is performed by the second classifier 9. In this regard, a passage 9*b* serves as a return passage in a circulating system including the second classifier 9 and the jet air pulverizer 7.

Namely, the second classifier 9 feeds relatively fine particles having particle diameters in the predetermined particle range to a third cyclone 10 through a passage 9*a* to round the particles and to remove particles having too small particle diameters, and feeds relatively large particles having particle diameters greater than the predetermined particle diameter range to the jet air pulverizer 7 through the passage 9*b* so that the large particles are re-pulverized. The thus rounded particles are then fed by a feeder 11 to be subjected to the next treatment.

Next, the toner to be prepared by the method of the present invention will be explained.

The toner includes toner particles, which are prepared by the method mentioned above and which includes at least a binder resin and a colorant, and optionally includes additives such as charge controlling agents and release agents; and an optional eternal additive present on the surface of the toner particles.

The toner particles preferably have a weight average particle diameter of from 2 to 6 μm and more preferably from 2 to 5 μm, and an average circularity of from 0.93 to 0.96, and preferably from 0.94 to 0.96.

The binder resin is not particularly limited, and any known resins for use in preparing toner by kneading/pulverizing methods can be used.

Specific examples of the binder resin for use in the toner include styrene polymers and substituted styrene polymers such as polystyrene, poly-p-chlorostyrene, polyvinyltoluene and the like; styrene copolymers such as styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers and the like; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like. These resins are used alone or in combination.

The colorant is not particularly limited, and any known pigments and dyes for use as colorants of toner can be used.

Specific examples of the pigments and dyes include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The toner optionally includes a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the marketed charge controlling agents include BONTRON 03 (Nigrosine dye), BONTRON P-51 (quaternary ammonium salt), BONTRONS-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

In addition, the toner can optionally include a release agent. Suitable release agents include waxes. When a wax is included in the toner, the wax is dispersed in the binder resin and serves as a release agent while being present at a location between a fixing roller and the toner particles in the fixing process. Thereby the hot offset problem can be avoided.

Specific examples of the waxes for use as the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes, polyethylene and polypropylene; and other synthesized waxes such as ester waxes, ketone waxes and ether waxes. Further, fatty acid amides such as 1,2-hydroxyl stearic acid amide, stearic acid amide and phthalic anhydride imide; and low molecular weight crystalline polymers such as acrylic homopolymer and copolymers having along alkyl group in their side chain, e.g., poly-n-stearyl methacrylate, poly-n-laurylmethacrylate and n-stearyl acrylate-ethyl methacrylate copolymers, can also be used.

The method for preparing the toner composition powder to be supplied to the toner preparation system illustrated in FIG. 1 is not particularly limited, but the typical method is as follows.

The toner constituents such as binder resins, colorants, and optional additives are mixed and kneaded upon application of heat thereto.

In this kneading process, the toner constituent mixture is contained in a kneader and then kneaded. Suitable kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

In the kneading process, it is important to control the kneading conditions so as not to cut the molecular chains of the binder resin used in the toner. Specifically, when the mixture is kneaded at a temperature much lower than the softening point of the binder resinused, the molecular chains of the binder resin tend to be cut. When the kneading temperature is too high, the pigment in the mixture cannot be fully dispersed.

After the kneaded toner constituent mixture is cooled, the mixture is crushed with a crusher so as to have a proper particle size of about 400 μm (i.e., so as to be preferably used for the toner preparation system illustrated in FIG. 1). Thus, the toner composition powder to be pulverized by the method mentioned above is prepared.

The toner particles prepared by the pulverization method mentioned above are optionally mixed with a particulate material (i.e., an external additive) to prepare the toner of the present invention.

The particulate material is not particularly limited, and proper materials are chosen among known materials such that the resultant toner fits for the purpose.

Suitable materials for use as the particulate material include inorganic materials such as oxides, titanates, sulfates, carbonates, nitrides, and other inorganic materials and organic materials.

Specific examples of the oxides include silicon dioxide (i.e., silica), titanium dioxide (i.e., titania), aluminum oxide (alumina), iron oxide, red iron oxide, copper oxide, zinc oxide, tin oxide, antimony trioxide, magnesium oxide, zirconium oxide, chromium oxide, cerium oxide, colloidal titanium oxide, colloidal silica, etc. Specific examples of the titanates include barium titanate, magnesium titanate, calcium titanate, strontium titanate, etc. Specific examples of the sulfates include barium sulfate, etc. Specific examples of the carbonates include barium carbonate, calcium carbonate, etc. Specific examples of the carbides include silicon carbide, etc. Specific examples of the nitrides include silicon nitride, etc. Other materials such as quartz sand, clay, mica, sand-lime, diatom earth, tricalcium phosphate and hydroxyapatite which is synthesized by reacting sodium phosphate with calcium chloride under a basic condition (i.e., in the presence of an alkali).

Among these materials, oxides are preferably used, and silicon dioxide, titanium dioxide and aluminum oxide are more preferably used.

Suitable particulate organic materials for use as the external additive include particles of polymers such as thermoplastic resins, and thermosetting resins. Specific examples of such polymers include polystyrene, methacrylate-acrylate copolymers, silicone resins, benzoguanamine resins, nylon resins, etc. Polymers prepared by a method such as soap-free emulsion polymerization methods, suspension polymerization methods, and dispersion polymerization methods can be preferably used as the particulate organic materials.

The particulate material preferably has a number average particle diameter of from 0.03 to 1 μm, and more preferably from 0.05 to 0.5 μm. When the particle diameter is too small, the toner tends to easily rotate, and thereby the toner has a poor cleanability. In contrast, when the particle diameter is too large, the particulate material is not uniformly adhered to the surface of the toner.

The toner of the present invention can be used alone as a one-component developer, but can be used for a two-component developer by being mixed with a carrier.

When the toner is used for a two-component developer, the added amount of the toner is preferably from 1 to 10 parts by weight per 100 parts by weight of a carrier.

Suitable materials for use as the carrier of the two component developer include known carrier materials such as iron powders, ferrite powders, magnetite powders, and magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethyl methacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethylene terephthalate resins and polybutylene terephthalate resins, polycarbonate resins, polyethylene resins, polyvinyl fluoride resins, polyvinylidene fluoride resins, polytrifluoroethylene resins, polyhexafluoropropylene resins, vinylidene fluoride-acrylate copolymers, vinylidene fluoride-vinyl fluoride copolymers, fluoroterpolymers (such as terpolymers of tetra fluoroethylene, vinylidene fluoride and other monomers including no fluorine atom), silicone resins, etc., can also be used for the resin layer.

If desired, an electroconductive powder may be included in the resin layer covering the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

Next, the image forming apparatus of the present invention will be explained.

Figure 2:
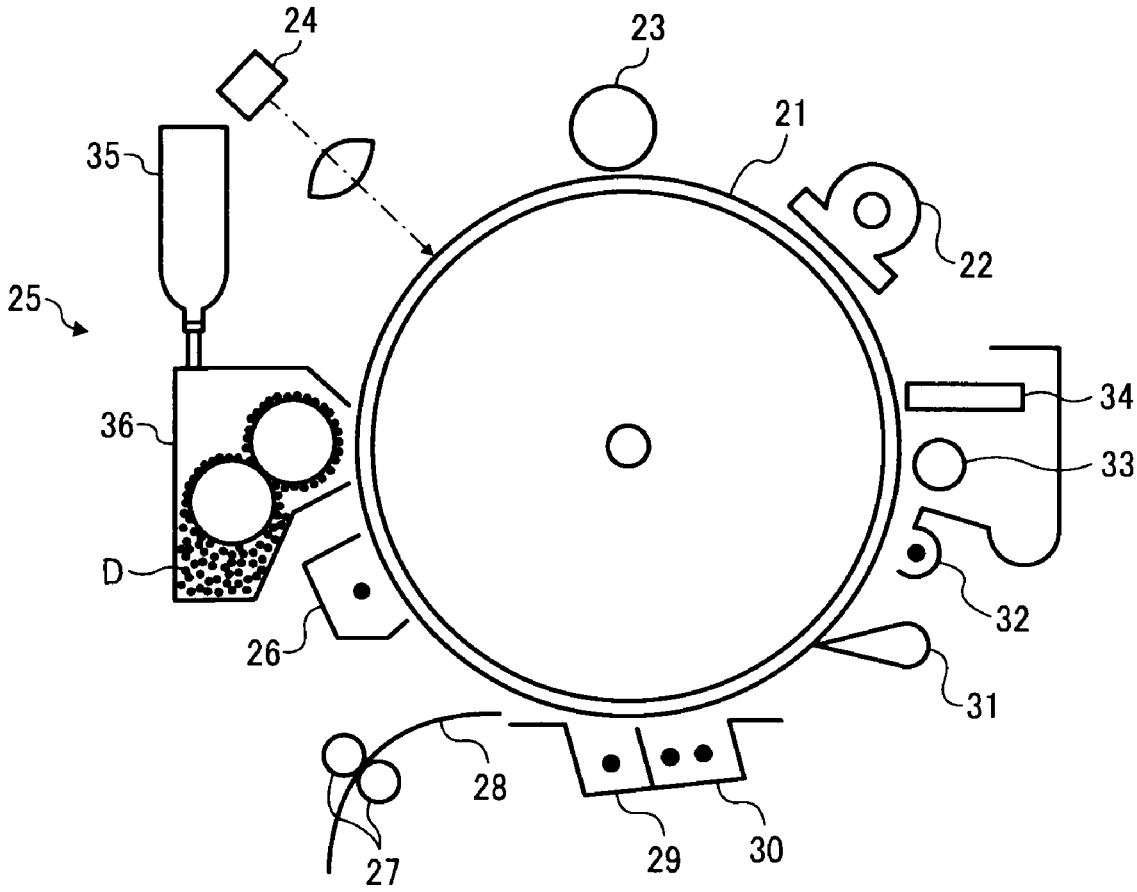
FIG. 2 is a schematic view illustrating an example of the image forming apparatus of the present invention.

FIG. 2 is a schematic view illustrating an example of the image forming apparatus of the present invention. The image forming apparatus of the present invention is not limited to the image forming apparatus illustrated in FIG. 2, and includes, for example, the modified versions mentioned below.

The image forming apparatus includes an image bearing member 21, which is typically a photoreceptor drum. Although the image bearing member 21 has a drum-form, the shape is not limited thereto and sheet-form and endless belt-form image bearing members can also be used.

The image forming apparatus further includes a discharging lamp 22 configured to discharge charges remaining on the image bearing member 21; a charging device 23 configured to charge the image bearing member 21; a light irradiating device 24 configured to irradiate the charged image bearing member 21 with image wise light to form an electrostatic latent image on a surface of the image bearing member 21; a developing device 25 configured to develop the latent image with a developer D including the toner mentioned above, which is a one-component developer (i.e., the toner) or a two-component developer including the toner and a carrier and which is contained in a developer containing portion 36 of the developing device 25, to form a toner image on the surface of the image bearing member 21; and a cleaning device including a fur brush 33 and a cleaning blade 34 configured to clean the surface of the image bearing member 21. The developing device 25 includes a toner container 35 containing the toner of the present invention, which is configured to supply the toner of the present invention to the developing portion 36 of the developing device. The toner container 35 may be a developer container including a carrier and the toner.

The image forming apparatus further includes a transferring device, which includes a pair of a transfer charger 29 and a separating charger 30 and which is configured to transfer the toner image formed on the image bearing member 21 to a sheet of a receiving material 28 fed by a pair of registration rollers 27; and a separating pick 31 configured to separate the receiving material sheet 28 bearing the toner image thereon from the image bearing member 21. The image forming apparatus of the present invention optionally includes a pre-transfer charger 26 configured to charge the toner image and image bearing member 21 before transferring the toner image to the receiving material sheet 28, and a pre-cleaning charger 32 configured to charge the image bearing member 21 before cleaning the surface of the image bearing member.

The image forming apparatus of the present invention includes at least an image bearing member, a charging device, a light irradiating device, and a developing device, and optionally includes a transferring device, a fixing device configured to fix the toner image on the receiving material, a cleaning device, a discharging device, etc. In addition, the image forming apparatus can include other devices.

Suitable charging devices for use as the charging device 23 include non-contact chargers such as corotrons and scorotrons; short-range chargers such as short-range charging rollers; contact chargers having a semiconductive charging element such as rollers, brushes, films and blades; etc.

Any devices capable of emitting light which can be absorbed by the charge generation material included in the image bearing member can be used for the light irradiating device. Specifically, when light irradiation is performed on a charged image bearing member and the light is absorbed by the charge generation material therein, a pair of charges having different polarities are formed in the image bearing member. One of the pair of charges moves toward the surface of the image bearing member, thereby decaying the charges on the surface of the charged image bearing member, resulting in formation of an electrostatic latent image on the image bearing member.

Light sources such as light emitting diodes (LEDs), laser diodes (LDs), light sources using electroluminescent lamps (EL), tungsten lamps, halogen lamps, mercury lamps, fluorescent lamps, sodium lamps, etc. can be used if the light sources satisfy the above-mentioned conditions. Among these light sources, light emitting diodes (LEDs) and laser diodes (LDs) can be preferably used because of having advantages such that the light irradiating device can be miniaturized, high speed image formation can be performed, and the effect of the present invention can be well produced. In addition, in order to obtain light having a desired wave length range, filters such as sharp-cut filters, band pass filters, near-infrared cutting filters, dichroic filters, interference filters, color temperature converting filters and the like can be used for the light irradiating device.

A multi-beam light irradiating device, particularly, vertical-cavity surface-emitting laser, is preferably used for the light irradiating device of the image forming apparatus of the present invention. In order to perform high speed image formation, the image scanning frequency in the sub-scanning direction has to be increased by increasing the revolution of the polygon mirror serving as a rotating polyhedral mirror. However, the revolution of polygon mirrors has a limit. Therefore, multi-beam light irradiating devices are preferably used. In multi-beam light irradiating devices, plural light beam sources are arranged in the sub-scanning direction to perform multi-beam scanning such that one main scanning operation is performed using plural light beams (i.e., a multi-beam recording head). When n pieces of light beams are used, the revolution of the polygon mirror can be decreased by 1/n in order to perform image formation at the same speed as that in a case where one light beam is used. In other words, image formation can be performed at a speed n-times that in a case where one light beam is used. In addition, since the scanning speed can be decreased in multi-beam scanning, the scanning density can be increased. Therefore, high quality images can be formed at a high speed.

In the developing process, an electrostatic latent image formed on the image bearing member is developed with a developer including the toner mentioned above to form a toner image on the surface of the image bearing member. When using a toner having a charge with the same polarity as that of the charge formed on the image bearing member, a negative image is formed on the image bearing member (i.e., reverse development is performed). When using a toner having a charge with a polarity opposite to that of the charge formed on the image bearing member, a positive image is formed on the image bearing member. Development methods are classified into one-component developing methods using a one-component developer including only a toner and two-component developing methods using a two-component developer including a toner and a carrier. Both the one-component developing methods and two-component developing methods can be used for the image forming apparatus of the present invention. When plural color images are formed on the image bearing member while overlaid to form a full color image, it is preferable not to contact the developer with the image bearing member to prevent the former toner images from being damaged by the developer used for forming another color image thereon. Therefore, non-contact developing methods such as jumping developing methods are preferably used.

In the transfer process, a toner image formed on the image bearing member is transferred onto a receiving material such as paper sheets. For example, chargers are used as the transferring device. More specifically, the transfer charger 29 (illustrated in FIG. 2) and a combination of the transfer charger 29 with the separation charger 30 can be preferably used. The transfer methods are classified into direct transfer methods in which an image is directly transferred to a receiving material and intermediate transfer methods in which an image is transferred to an intermediate transfer medium, and the image is then transferred to a receiving material. Both the transfer methods can be used for the image forming apparatus of the present invention. Since the intermediate transfer methods have an advantage in that high quality images can be formed, the methods are preferably used for full color image forming apparatus. However, the intermediate transfer methods are disadvantageous in high-speed image formation and miniaturization of image forming apparatus. Therefore, it is preferable to use a proper transfer method depending on the application of the image forming apparatus.

In addition, the transfer methods are classified into constant-voltage transfer methods, and constant-current transfer methods. Both the transfer methods can be used for the image forming apparatus of the present invention. However, constant-current transfer methods are preferably used because the amount of transferred charges is constant, and thereby the transfer process can be stably performed. As the transfer current increases, the transferability of toner images improves. When the linear speed of the image bearing member increases, the transferability deteriorates. In this case, it is preferable to increase the transfer current. In addition, it is preferable to increase the transfer current because the amount of charges flowing through the image bearing member in the discharging process can be decreased, resulting in reduction of electrostatic fatigue of the image bearing member. However, when the transfer current is so high that the image bearing member is positively charged, the charges on the image bearing member cannot be fully decayed in the following discharging process. When the image bearing member in such a state is charged under the same charging conditions, a problem in that the potential of the image bearing member is lower than the predetermined potential occurs. Therefore, it is preferable to apply a proper transfer current in order to prevent occurrence of the first one-revolution charge problem.

In the fixing process, a toner image transferred on a receiving material is fixed thereto. Any fixing methods can be used for the image forming apparatus of the present invention as long as toner images can be fixed on receiving materials. Among various fixing methods, heat/pressure fixing methods in which a toner image is fixed on a receiving material upon application of heat and pressure thereto are preferably used. Specifically, fixing devices having a combination of a heat roller and a pressure roller, or a combination of a heat roller, a pressure roller and an endless belt can be preferably used.

In the cleaning process, foreign materials present on the surface of the image bearing member, such as toner particles remaining on the surface of the image bearing member without being transferred to an intermediate transfer medium or a receiving material, are removed with a cleaning device. Any cleaning devices can be used as long as foreign materials can be removed thereby. Specifically, cleaning devices using a fur brush or a blade, or a combination thereof can be preferably used. In addition, other cleaning devices using a magnetic brush, an electrostatic brush or a magnetic roller can also be used.

When the surface of the image bearing member is contaminated not only with residual toner particles but also with other materials such as components included in the developer, dust produced by receiving paper sheets, and products of discharging caused by the charging process, the qualities of images deteriorate. In the cleaning process, these foreign materials are removed by a cleaning device. However, after long repeated use, the foreign materials tend to be adhered to the surface of the image bearing member, resulting in deterioration of image qualities or formation of abnormal images. In order that foreign materials are not easily adhered to the image bearing member (resulting in prevention of occurrence of such an adhesion problem), it is preferable to include a lubricant in the surface portion of the image bearing member or to apply a lubricant on the surface of the image bearing member.

Applying a lubricant on the image bearing member offers another advantage in that the friction between the surface of the image bearing member and a cleaning blade can be reduced, resulting in stabilization of behavior of the cleaning blade, thereby preventing occurrence of defective cleaning. In addition, abrasion loss of the surface of the surface of the image bearing member caused by the friction can be reduced. Further, the excess of the lubricant applied on the surface of the image bearing member can be removed by the cleaning blade. In this case, foreign materials adhered to the surface can also be removed together with the excess lubricant, resulting in prevention of a filming problem in that the foreign materials form a film on the surface of the image bearing member. Particularly when the image bearing member has a protective layer (i.e., an outermost layer) including a filler, a lubricant can be evenly applied on the surface of the image bearing member, and thereby the cleanability, and resistance to abrasion and scratches of the image bearing member can be improved. Therefore, it is preferable to apply a lubricant on the surface of the image bearing member.

The toner preparation method of the present invention will be further explained by reference to specific examples, which are provided herein for the purpose of illustration only and are not intended to be limiting.

EXAMPLES

Preparation of Toner Component Powder

The following components (i.e., toner composition) were mixed and heated.

| | |
|---|---|
| Styrene-acrylic copolymer | 100 parts by weight |
| Carbon black | 10 parts by weight |
| Polypropylene | 5 parts by weight |
| Zinc salicylate | 2 parts by weight |

The mixture was melted and kneaded. After being cooled, the kneaded mixture was crushed to prepare a toner composition powder having an average particle diameter of about 400 μm.

Comparative Example 1

The toner composition powder prepared above was pulverized only by the mechanical pulverizer of the toner preparation system illustrated in FIG. 1 without using the jet air pulverizer. In this regard, a classifier was used to remove too fine particles and too coarse particles (which were returned to the mechanical pulverizer to be re-pulverized), the amount of the toner composition powder fed to the mechanical pulverizer was 20 kg/h, and the peripheral speed of the rotor of the mechanical pulverizer was 164 m/s (i.e., the revolution of the rotor was 5200 rpm).

As shown in Table 1, the specific energy consumption of the method was 0.4 to 0.7 t/t, which is the best among the methods illustrated in Table 1. However, the resultant toner particles have a weight average particle diameter of 8 μm, which is greater than the target particle diameter range of from 2 to 6 μm, and an average circularity of 0.94, which falls in the target range. In addition, the qualities of images produced by this toner were bad. Therefore, the method is classified into a bad grade (A) because the method has one drawback (i.e., large weight average particle diameter). This method has advantages such as good productivity and high yield.

In this regard, the mechanical pulverizer 3 illustrated in FIG. 1 used for forming the toner of Comparative Example 1 has a rotor rotated at a high speed, and a stator arranged around the rotor. The toner composition powder was fed into a circular gap formed between the rotor and the stator to be pulverized. By using such a mechanical pulverizer, a powder can be pulverized at an energy much lower than that used for jet air pulverizers while preventing excessive pulverization of the powder (i.e., reducing the amount of fine particles), resulting in improvement of the yield of the toner particles.

However, as mentioned above, such a mechanical pulverizer cannot produce toner particles having a weight average particle diameter of less than 8 μm (i.e., the lower limit of the weight average particle diameter of the resultant tone particles is 8 μm) due to the pulverization mechanism thereof.

The reason therefor is considered as follows.

Specifically, the force (F) pulverizing a particle is represented by the following equation:

$$F=\frac{1}{2}(m\times V\times V)=\frac{1}{2}(mV^2)$$

where in m represents the weight of the particle, and V represents the collision velocity of the particle.

In this regard, the collision velocity is about 140 m/s in mechanical pulverizers where as the collision velocity is about 850 m/s in jet air pulverizers.

Therefore, when only a mechanical pulverizer is used, toner particles having a small weight average particle diameter of from 2 to 6 μm, which is a requirement for the toner used for recent electrophotographic image forming apparatus to produce high quality images, cannot be produced.

Comparative Example 2

The toner composition powder prepared above was pulverized only by the jet air pulverizer of the toner preparation system illustrated in FIG. 1 without using the mechanical pulverizer. In this regard, a classifier was used to remove too fine particles and too coarse particles (which were returned to the jet air pulverizer to be re-pulverized), and the amount of the toner composition powder fed to the jet air pulverizer was 20 kg/h.

As shown in Table 1, the specific energy consumption of this method was 2.0 to 2.8 t/t, which is the worst among the methods illustrated in Table 1. The resultant toner particles have a weight average particle diameter of 6 μm, which falls in the target particle diameter range of from 2 to 6 μm, and an average circularity of 0.92, which falls out of the desired range of from 0.93 to 0.96. The qualities of images produced by the toner were acceptable. Therefore, the method is classified into a seriously bad grade (X) because the method has two drawbacks (i.e., large specific energy consumption and low average circularity).

As for the jet air pulverizer 7, conventional jet air pulverizers can be used. When a powder having an average particle diameter of from 300 to 500 μm is pulverized with such a jet air pulverizer to prepare a fine powder having an average particle diameter of from 2 to 6 μm, the specific energy consumption seriously increases (i.e., the productivity is bad), and in addition the yield is also bad. The specific energy consumption of this method is about three times the desired specific energy consumption.

Comparative Example 3

The toner composition powder prepared above was pulverized only by a counter airflow pulverizer without using a mechanical pulverizer and a jet air pulverizer. In this regard, the amount of the toner composition powder fed to the counter airglow pulverizer was 20 kg/h. In this method, a classification treatment and a rounding treatment were not performed, but the counter airflow pulverizer has configuration such that relatively fine particles having particle diameters not greater than the upper limit of the predetermined particle diameter range are flown upward to be fed to the next process and coarse particles having particle diameters greater than the upper limit of the predetermined particle diameter range fall on the counter airflow pulverizer to be re-pulverized.

As shown in Table 1, the specific energy consumption of this method was 1.3 to 1.9 t/t, which is relatively large among the methods illustrated in Table 1. The resultant toner particles have a weight average particle diameter of 6 μm, which falls in the target particle diameter range of from 2 to 6 μm, and an average circularity of 0.92, which falls out of the desired range of from 0.93 to 0.96. The qualities of images produced by the toner were acceptable. Therefore, the method is classified into a seriously bad grade (X) because the method has two drawbacks (i.e., large specific energy consumption and low average circularity).

In recent years, toner with a small average particle diameter of from 2 to 6 μm is typically prepared using a counter airflow pulverizer.

In counter airflow pulverizers, a powder to be pulverized is fed by a high pressure gas such as jet air, and sprayed from exits of opposing accelerating tubes so that the powder is pulverized by collisions from opposing sprays, resulting in pulverization of the powder due to the impact force from the collisions.

Although toner with a small average particle diameter of from 2 to 6 μm can be prepared by a counter airflow pulverizer, a huge amount of air has to be used for pulverization. Therefore, the electric energy consumption of the compressor used for supplying air is very large, i.e., the pulverizer has a high energy cost, which is a drawback. This is because, in recent years, energy saving machines are required for preparing toner in view of environmental protection. In addition, when a toner is prepared using such a counter airflow pulverizer, a large amount of fine particles are produced, and thereby the yield of the toner deteriorates because such fine particles are removed in the following classification process. Thus, the counter airflow pulverizer has poor toner productivity.

Comparative Example 4

The toner composition powder prepared above was pulverized by a two-step pulverizing method using two jet air pulverizers. In this regard, a classifier was used to remove too fine particles and too coarse particles (which were returned to the pulverizer to be re-pulverized), and the amount of the toner composition powder fed to the jet air pulverizers was 20 kg/h.

As shown in Table 1, the specific energy consumption of this method was 1.4 to 2.2 t/t, which is relatively large among the methods illustrated in Table 1. The resultant toner particles have a weight average particle diameter of 6 μm, which falls in the target particle diameter range of from 2 to 6 μm, and an average circularity of 0.92, which falls out of the desired range of from 0.93 to 0.96. The qualities of images produced by the toner were acceptable. Therefore, the method is classified into a seriously bad grade (X) because the method has two drawbacks (i.e., large specific energy consumption and low average circularity).

As for the jet air pulverizers, conventional jet air pulverizers can be used. When a powder having an average particle diameter of from 300 to 500 μm is pulverized with two jet air pulverizers to prepare a fine powder having an average particle diameter of from 2 to 6 μm, the specific energy consumption increases (i.e., the productivity is bad), and in addition the yield is also bad. The specific energy consumption of this method is about two times the desired specific energy consumption.

Comparative Example 5

It is assumed that the toner composition powder prepared above is pulverized by a two-step pulverizing method using the mechanical pulverizer and the jet air pulverizer of the toner preparation system illustrated in FIG. 1 without performing the two-step classification treatment (i.e., a combination of the methods of Comparative Examples 1 and 2). In this regard, the amount of the toner composition powder fed to the mechanical pulverizer is 20 kg/h.

The predicted evaluation results are shown in Table 1. In this regard, the evaluation results are predicted on the basis of the results of the methods of Comparative Examples 1 and 2 (i.e., average of the results of the methods of Comparative Examples 1 and 2).

According to the predicted evaluation results, the specific energy consumption is considered to be 1.2 to 1.8 t/t, which falls out of the desired range of not greater than 1.0 t/t. The toner particles are considered to have a weight average particle diameter of 7 μm, which falls out of the target particle diameter range of from 2 to 6 μm, and an average circularity of 0.93, which falls in the desired range of from 0.93 to 0.96. The qualities of images produced by the toner are considered to be acceptable. Therefore, the method is considered to be classified into a seriously bad grade (X) because the method has two drawbacks (i.e., large specific energy consumption and large weight average particle diameter).

In this regard, the average particle diameter and the average circularity of the toners were determined using the following methods.

Average Particle Diameter

The particle diameter and particle diameter distribution of a toner are measured by a method using an instrument such as COULTER COUNTER TA-II and COULTER MULTISIZER II from Beckman Coulter Inc. Specifically, the procedure is as follows:

(1) a surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter Inc.;

(2) 2 to 20 mg of a sample to be measured is added into the electrolyte;
(3) the mixture is subjected to an ultrasonic dispersion treatment for about 1 to 3 minutes; and
(4) the volume-basis particle diameter distribution and number-basis particle diameter distribution of the sample are measured using the instrument mentioned above and an aperture of 100 μm.

In the present invention, the following 13 channels are used:
(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted. The weight average particle diameter (D4) and number average particle diameter (Dn) are determined from the number-basis particle diameter distribution.

Average Circularity

The average circularity of a particulate material (such as toner particles) was determined by the following method using a flow-type particle image analyzer FPIA-1000 from Sysmex Corp.
(1) At first, 10 ml of water, from which solid foreign materials having particle diameters in the measurement range (i.e., circle-equivalent diameter of not less than 0.60 μm and less than 159.21 μm) have been removed using a filter so that the number of such foreign materials therein is not greater than 20 pieces per $10^{-3}$ $cm^3$, is mixed with few drops of a nonion surfactant (preferably, CONTAMINON N from Wako Pure Chemical Industries, Ltd.);
(2) Five (5) milligrams of a sample to be measured is added to the mixture of water and the surfactant;
(3) The mixture is subjected to a supersonic dispersion treatment for 1 minute using a supersonic dispersion machine UH-50 (from STM Co.) under conditions of 20 kHz in frequency and 50 W/10 $cm^3$ in power, followed by an additional dispersion treatment for 4 minutes (5 minutes in total) to prepare a dispersion including particles of the sample (in the measurement range) of from 4,000 to 8,000 pieces/$10^{-3}$ $cm^3$; and
(4) The particle diameter distribution of the sample in the measurement range of not less than 0.60 μm and less than 159.21 μm in circle-equivalent diameter is determined using the particle image analyzer.

In the analyzer, the dispersion is flown through a passage (i.e., a flat transparent flow cell having a thickness of about 200 μm). A flash lamp emitting light at regular intervals of 1/30 sec and a CCD camera are provided in the analyzer so as to be opposed with each other with the flat transparent flow cell there between. Images of the particles passing through the cell are caught by the combination of the flash lamp and CCD camera. Thus, two-dimensional images of the particles present in a unit area of the cell are formed on the CCD camera. By analyzing the two-dimensional images, the particle diameters (i.e., circle-equivalent diameter) of the particles therein are calculated.

The analyzer can measure the particle diameters of not less than 1200 for 1 minute, and determine a particle diameter distribution (i.e., the number (percentage) of particles in each of particle diameter ranges (channels)). In this regard, the measurement particle diameter range of from 0.06 μm to 400 μm is separated to 226 channels (i.e., 30 channels per 1 octave). As a result, the percentage of the particles having particle diameters in each channel and the cumulative percentage of the particles are determined. As mentioned above, in this application, the particle diameter measurement is performed in the range of not less than 0.60 μm and less than 159.21 μm.

The circularity of a particle is defined by the following equation:

$$\text{Circularity}=Cs/Cp,$$

wherein Cp represents the length of the circumference of the projected image of a particle and Cs represents the length of the circumference of a circle having the same area as that of the projected image of the particle.

The average circularity is determined by averaging circularities of particles of the sample.

TABLE 1

| | Specific energy consumption (Target: not greater than 1.0 t/t) | Weight average particle diameter (Target: 2 to 6 μm) | Average circularity (Target: 0.93 to 0.96) | Overall evaluation (Δ: One drawback, X: two drawbacks) |
|---|---|---|---|---|
| Comp. Ex. 1 | 0.4 to 0.7 | 8 | 0.94 | Δ |
| Comp. Ex. 2 | 2.0 to 2.8 | 6 | 0.92 | X |
| Comp. Ex. 3 | 1.3 to 1.9 | 6 | 0.92 | X |
| Comp. Ex. 4 | 1.4 to 2.2 | 6 | 0.92 | X |
| Comp. Ex. 5 | 1.2 to 1.8 | 7 | 0.93 | X |

Example 1

The toner composition powder prepared above was pulverized using the toner preparation system illustrated in FIG. 1. In this case, the cyclones 8 and 10 were not used (the cyclone 4 was used), and the two pulverizers (the mechanical pulverizer and the jet air pulverizer) and two classifiers were used. In addition, the peripheral speed of the rotor of the mechanical pulverizer was 164 m/s (i.e., the revolution of the rotor was 5200 rpm), the amount of the toner composition powder fed to the mechanical pulverizer was 20 kg/h, and the air pressure was 0.5 Mpa.

As shown in Table 2, the specific energy consumption of this method was 0.7 to 0.9 t/t, which falls in the target range. The resultant toner particles have a weight average particle diameter of 6 μm and an average circularity of 0.94, both of which fall in the respective target ranges. The resultant toner had a good combination of developing property, transferring property, cleaning property and charging property, and therefore the qualities of images produced by the toner were good. Therefore, the method is classified into a good grade (○) because the method has no drawback.

Example 2

The toner composition powder prepared above was pulverized using the toner preparation system illustrated in FIG. 1. In this case, the cyclones 8 and 10 were not used (the cyclone 4 was used), and the two pulverizers (the mechanical pulverizer and the jet air pulverizer) and two classifiers were used. In addition, the peripheral speed of the rotor of the mechanical pulverizer was 164 m/s (i.e., the revolution of the rotor was 5200 rpm), the amount of the toner composition powder fed to the mechanical pulverizer was 20 kg/h, and the air pressure was 0.7 Mpa.

As shown in Table 2, the specific energy consumption was 0.8 to 1.0 t/t, which falls in the target range. The resultant toner particles have a weight average particle diameter of 5 μm and an average circularity of 0.94, both of which fall in the respective target ranges. The resultant toner had a good combination of developing property, transferring property, cleaning property and charging property, and therefore the qualities of images produced by the toner were good. Therefore, the method is classified into a good grade (○) because the method has no drawback.

Example 3

The toner composition powder prepared above was pulverized using the toner preparation system illustrated in FIG. 1. In this case, all the cyclones were used, namely, the two pulverizers (the mechanical pulverizer and the jet air pulverizer), two classifiers and three cyclones were used. In addition, the peripheral speed of the rotor of the mechanical pulverizer was 164 m/s (i.e., the revolution of the rotor was 5200 rpm), the amount of the toner composition powder fed to the mechanical pulverizer was 20 kg/h, and the air pressure was 0.5 Mpa.

As shown in Table 2, the specific energy consumption was 0.7 to 0.9 t/t, which falls in the target range. The resultant toner particles have a weight average particle diameter of 6 μm and an average circularity of 0.96, both of which fall in the respective target ranges. The resultant toner had a good combination of developing property, transferring property, cleaning property and charging property, and therefore the qualities of images produced by the toner were good. Therefore, the method is classified into a good grade (○) because the method has no drawback.

Example 4

The toner composition powder prepared above was pulverized using the toner preparation system illustrated in FIG. 1. In this case, all the cyclones were used, namely, the two pulverizers (the mechanical pulverizer and the jet air pulverizer), two classifiers and three cyclones were used. In addition, the peripheral speed of the rotor of the mechanical pulverizer was 164 m/s (i.e., the revolution of the rotor was 5200 rpm), the amount of the toner composition powder fed to the mechanical pulverizer was 20 kg/h, and the air pressure was 0.7 Mpa.

As shown in Table 2, the specific energy consumption was 0.8 to 1.0 t/t, which falls in the target range. The resultant toner particles have a weight average particle diameter of 5 μm and an average circularity of 0.96, both of which fall in the respective target ranges. The resultant toner had a good combination of developing property, transferring property, cleaning property and charging property, and therefore the qualities of images produced by the toner were good. Therefore, the method is classified into a good grade (○) because the method has no drawback.

TABLE 2

| | Specific energy consumption (Target: not greater than 1.0 t/t) | Weight average particle diameter (Target: 2 to 6 μm) | Average circularity (Target: 0.93 to 0.96) | Overall evaluation (○: No drawback, Δ: one drawbacks) |
|---|---|---|---|---|
| Ex. 1 | 0.7 to 0.9 | 6 | 0.94 | ○ |
| Ex. 2 | 0.8 to 1.0 | 5 | 0.94 | ○ |
| Ex. 3 | 0.7 to 0.9 | 6 | 0.96 | ○ |
| Ex. 4 | 0.8 to 1.0 | 5 | 0.96 | ○ |

As illustrated in Table 2, the toner preparation methods of the present invention can produce good results, which cannot be expected from the results of the method of Comparative Example 1 and the method of Comparative Example 2 (i.e., the method of Comparative Example 5).

As mentioned above, the toner preparation method of the present invention can stably produce toner particles having a high circularity and a sharp particle diameter distribution with a little amount of superfine particles at a low energy consumption and a high yield. The toner produced by the method has a long life and a good combination of developing property, transferring property, cleaning property and charging property.

This document claims priority and contains subject matter related to Japanese Patent Application No. 2008-068574, filed on Mar. 17, 2008, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for preparing a toner comprising:

primarily pulverizing a toner composition powder including at least a binder resin and a colorant using a mechanical pulverizer to prepare a first particulate material with a weight average particle diameter of from 7 to 30 μm;

secondarily pulverizing the first particulate material using a jet air pulverizer having a pulverization plate to prepare a second particulate material; and classifying the second particulate material in two steps to prepare particles of the toner with a weight average particle diameter of from 2 to 6 μm and an average circularity of from 0.93 to 0.96, wherein the primarily pulverizing step includes:

primarily pulverizing a toner composition powder including at least a binder resin and a colorant using a mechanical pulverizer having a rotor rotated at a peripheral speed of not lower than 120 m/s while rounding the primarily pulverized toner composition powder to prepare a first particulate material with a weight average particle diameter of from 7 to 20 μm and an average circularity of from 0.94 to 0.96; and wherein the classifying step includes:

classifying the second particulate material in two steps to prepare particles of the toner with a weight average particle diameter of from 2 to 5 μm and an average circularity of from 0.93 to 0.96.

2. A method for preparing a toner comprising:

primarily pulverizing a toner composition powder including at least a binder resin and a colorant using a mechanical pulverizer to prepare a first particulate material with a weight average particle diameter of from 7 to 30 μm;

secondarily pulverizing the first particulate material using a jet air pulverizer having a pulverization plate to prepare a second particulate material; and classifying the second particulate material in two steps to prepare particles of the toner with a weight average particle diameter of from 2 to 6 μm and an average circularity of from 0.93 to 0.96, wherein the classifying step is performed using first and second classifiers including respective first and second cyclones, and comprises:

primarily classifying the second particulate material using the first classifier;

colliding the primarily classified particles with an inner surface of the first cyclone to round the primarily classified particles;

secondarily classifying the rounded primarily classified particles using the second classifier; and colliding the secondarily classified particles with an inner surface of the second cyclone to round the secondarily classified particles to prepare particles of the toner with a weight average particle diameter of from 2 to 6 μm and an average circularity of from 0.94 to 0.96.

3. A method for preparing a toner comprising:

primarily pulverizing a toner composition powder including at least a binder resin and a colorant using a mechanical pulverizer to prepare a first particulate material with a weight average particle diameter of from 7 to 30 μm;

secondarily pulverizing the first particulate material using a jet air pulverizer having a pulverization plate to prepare a second particulate material; and classifying the second particulate material in two steps to prepare particles of the toner with a weight average particle diameter of from 2 to 6 μm and an average circularity of from 0.93 to 0.96, wherein the primarily pulverizing step comprises:

primarily pulverizing a toner composition powder including at least a binder resin and a colorant using a mechanical pulverizer; and classifying the primarily pulverized toner composition powder to prepare a first particulate material with a weight average particle diameter of from 7 to 30 μm.

* * * * *